United States Patent [19]

Waldrum

[11] Patent Number: 4,662,565

[45] Date of Patent: May 5, 1987

[54] PESTICIDE SPRAYING DEVICE

[75] Inventor: John E. Waldrum, Ambler, Pa.

[73] Assignee: The Dow Chemical Company, Midland, Mich.

[21] Appl. No.: 718,611

[22] Filed: Apr. 1, 1985

Related U.S. Application Data

[63] Continuation-in-part of Ser. No. 592,776, Mar. 26, 1984.

[51] Int. Cl.[4] ..... B05B 3/08; B05B 3/00; B05B 3/04

[52] U.S. Cl. ..... 239/236; 239/227; 239/240; 239/225.1

[58] Field of Search ..... 239/1, 225, 227, 236, 239/249, 241; 74/66, 86, 47

[56] References Cited

U.S. PATENT DOCUMENTS

| | | | |
|---|---|---|---|
| 910,400 | 1/1909 | Lischer | 239/225 |
| 2,511,969 | 9/1945 | Chapin | 239/225 |
| 2,858,836 | 8/1957 | Geh et al. | 239/225 |
| 4,351,476 | 9/1982 | Looper | 239/227 |

FOREIGN PATENT DOCUMENTS

| | | | |
|---|---|---|---|
| 612864 | 11/1948 | United Kingdom | 239/227 |

*Primary Examiner*—Joseph F. Peters, Jr.
*Assistant Examiner*—Patrick N. Burkhart
*Attorney, Agent, or Firm*—Edward E. Schilling; Ronald G. Brookens

[57] ABSTRACT

A low drift spray apparatus for controllably continuously pivoting the nozzle during discharge of spray composition whereby the emitting spray pattern describes the frustum of a cone as the nozzle pivots includes a flexible tubular segment of the liquid supply line adjacent to the nozzle; a pivotal support adjacent the nozzle for pivotally supporting an end of the flexible tubular segment about a fixed point; a fixed support at the other end of the segment, the segment being axially compressed to cause lateral displacement of a portion thereof; and a reciprocating subassembly adapted to continuously move the laterally displaced portion in a circular path substantially about an axis consisting of a line between the ends of the segment.

14 Claims, 15 Drawing Figures

PESTICIDE SPRAYING DEVICE

RELATIONSHIP TO PRIOR APPLICATION

This is a continuation-in-part of application Ser. No. 592,776 filed Mar. 26, 1984.

BACKGROUND OF THE INVENTION

1. Field of the Invention

The invention relates to a spraying device and method and more specifically to a nozzle manipulating device for the spraying of a pesticide such as a herbicide, for example, along a swath beside a highway or railroad track bed while the spraying equipment is carried on a mobile platform. The device is useful for land-based or aerial spraying of industrial property, rights of way, agricultural lands and forest lands, wherever the mobile platform, or spray vehicle, can go as a practical matter. The greatest usefulness is believed to be in the spraying at rights of way.

2. Description of the Prior Art

Applicators using spraying equipment in any such setting must be concerned with achieving adequate coverage of the swath width, sometimes as wide as 40 to 60 feet, while avoiding the formation of fine droplets which are easily carried by slight air movement resulting in "drift" beyond the target area.

Generally attempts to avoid formation of fine droplets while yet achieving uniform coverage of the target area have been directed to moving the discharge nozzle, and/or its support, in a special rotational or oscillational pattern, as well as using specific nozzle orifice designs which minimize the formation of mists and fine droplets. Some of these devices present problems in service life and difficulties in servicing or in achieving uniformity of coverage.

Various approaches are to be found in the devices more fully described in my earlier U.S. Pat. Nos. 4,231,520, 3,931,930 and 3,642,206. Other spraying apparatus is described in my earlier U.S. Pat. Nos. 3,653,598; 3,648,935; 3,523,646; 3,399,638; 3,285,516; 3,220,653; 3,199,786 and 3,170,264.

SUMMARY OF THE INVENTION

The present spray applicator device or apparatus provides means for pivotally supporting the nozzle means, whether a single nozzle or a nozzle array, and pivoting the axis of the nozzle means in such a manner as to impart an orbital motion to the discharge end of the nozzle or nozzles, while the spray applicator device including related supporting and actuating means and pesticide composition supply means are operated and transported along a strip of land to be sprayed, e.g., a railroad track or a highway right of way and a tank mix of an appropriate pesticide composition, generally aqueous, is controllably discharged from the nozzle means in a swath up to at least 50 feet wide upon the adjacent right of way with minimal spray drift problems.

The method of the invention is directed to pivoting about a fixed point, the liquid supply conduit means on which nozzle means are carried, at a preselected angular rate of rotation during discharge of pesticide composition and while transporting the spray apparatus along the swath to be sprayed.

THE DRAWINGS

FIG. 1 is a view in side elevation of the novel spray apparatus employing the nozzle and fluid discharge means pivoting mechanism of the invention;

FIG. 2 is an enlarged end view taken along line 2—2 of FIG. 1 partly in section and with the cover plate removed along with the ball socket bearing mount supported thereby, exposing to view the pivoting mechanism consisting of a motor driven disc wheel, a connecting rod carried thereby, an oscillatable guide through which the connecting rod reciprocates, and a yoke and cap surrounding flexible liquid conduit means, the yoke being connected to the connecting rod;

MORE DETAILED DESCRIPTION OF THE INVENTION

Figure 1:
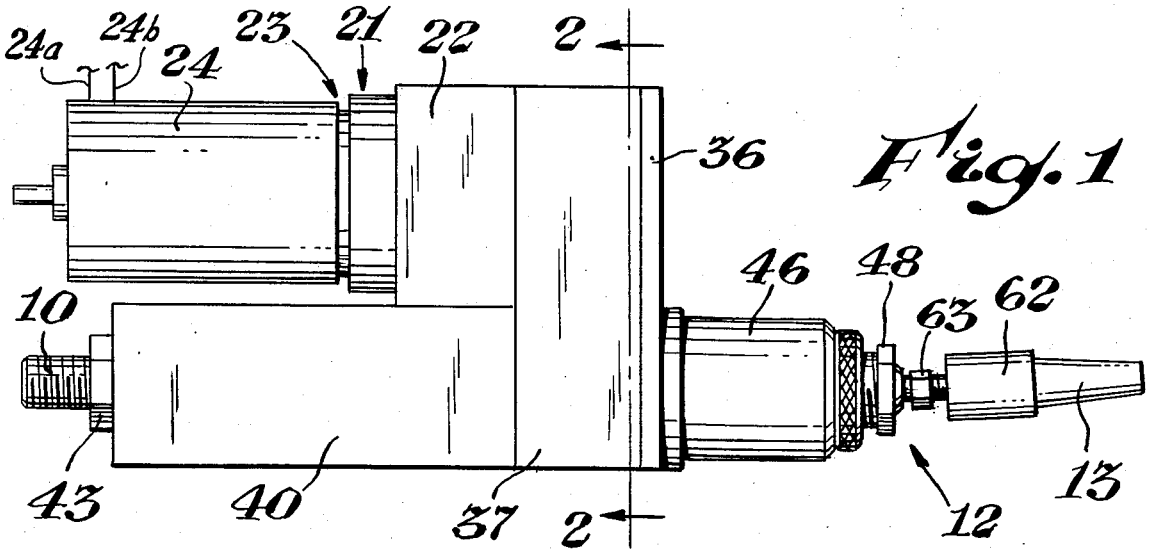
Figure 5:
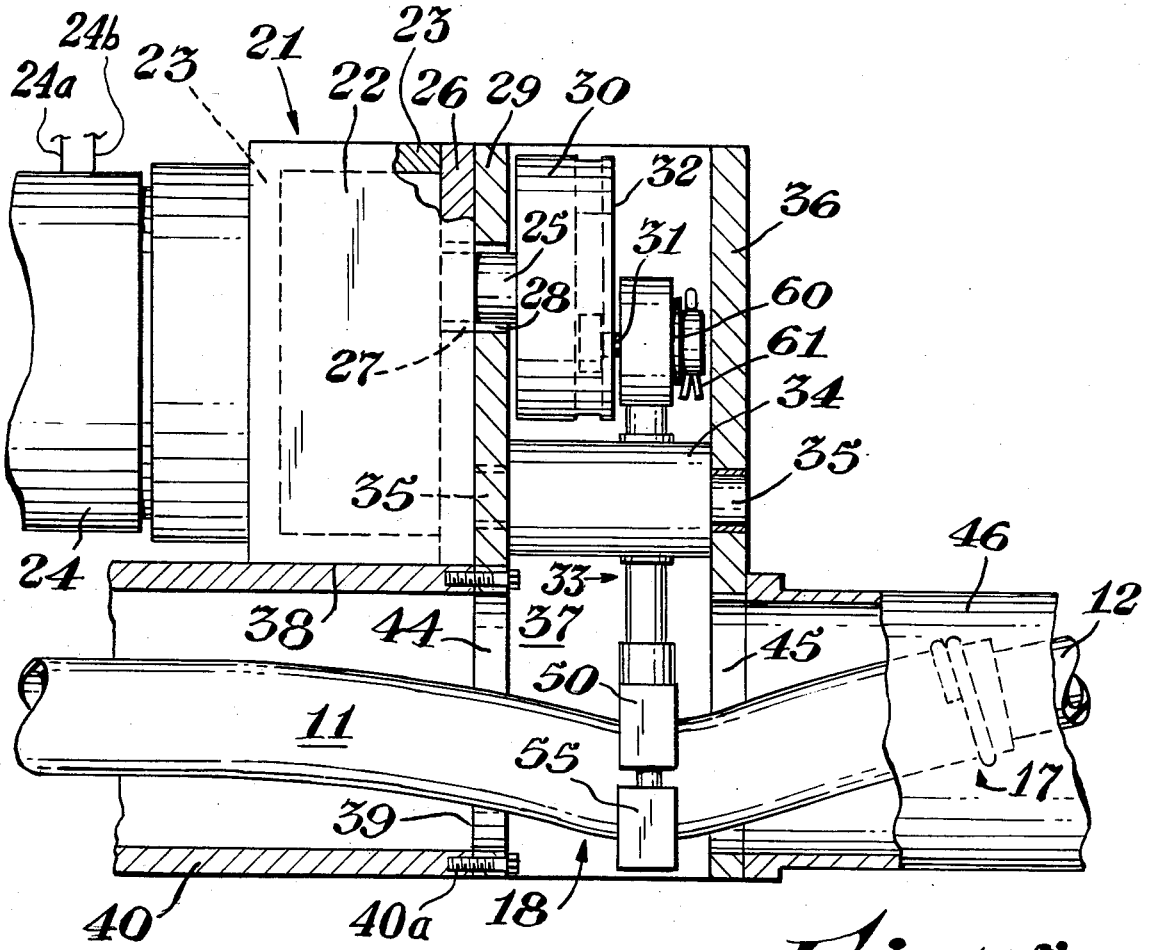
FIG. 5 is an enlarged fragmentary side view, partly broken away and in section, of the spray apparatus of FIG. 1, showing the relationship of the oscillatory mechanism to the flexible liquid conduit means with the connected portion of the flexible spray liquid conduit means in a laterally displaced condition.
Figure 6:
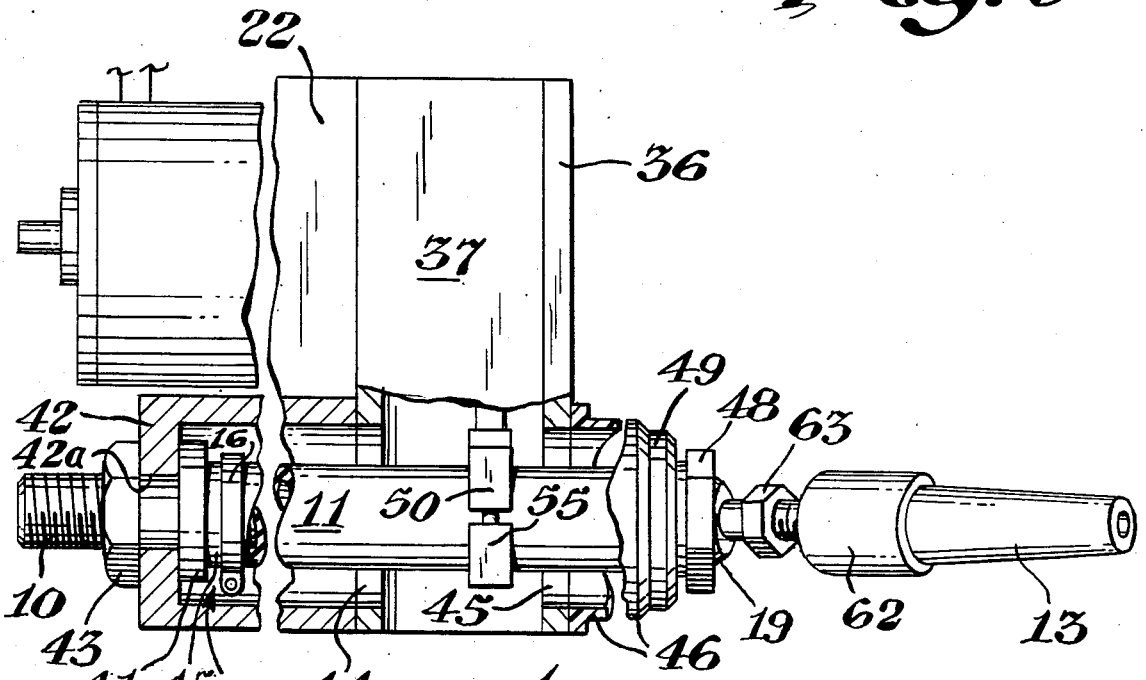
FIG. 6 is an enlarged foreshortened side view, partly broken away and in section, of the spray apparatus of FIG. 1, showing the electric motor drive means and the relationship of the rigid spray composition supply means to the flexible liquid conduit means, the relationship of the latter to the pivotal fluid discharge means and nozzle connected thereto being set forth in greater detail in FIG. 10.
Figure 10:
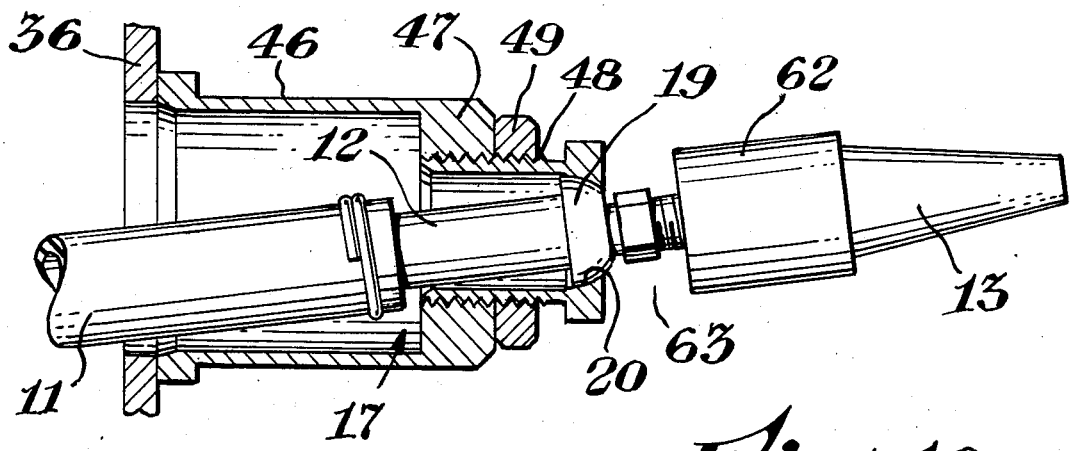
FIG. 10 is an enlarged fragmentary side view, partly in section, showing the flexible liquid conduit means connected to the pivotal rigid fluid discharge means having a partial ball portion and the relationship of the latter to the ball socket bearing and the mount therefor, and a nozzle attached to the rigid fluid discharge means.

Referring to FIGS. 1, 5, 6 and 10, one embodiment of the spray applicator of the invention is seen to include a composite liquid supply means made up of a rigid tubular member 10 connected as shown in FIG. 6, to a flexible tubular member 11, which interconnects the fixed rigid tubular member 10 and a pivotal rigid tubular member indicated generally by the reference numeral 12, as shown more particularly in FIG. 10. In turn, the pivotal rigid tubular member 12 is connected to the nozzle means 13, here a single nozzle, as shown in FIGS. 1, 6 and 10.

The fixed rigid tubular member 10 is to be understood to be adapted to be connected by liquid conduit means to the discharge side of a pump drawing sprayable liquid pesticide composition from a tank mix thereof at a controllable rate, all of which is conventional and well understood and is not illustrated herein.

Referring now to FIG. 6, it is essential that the said composite liquid supply means be fixedly supported adjacent the coupling, indicated generally by the reference numeral 14, of the flexible tubular member 11 to the rigid tubular member 10. The coupling shown consists of the end portion 15 of the flexible tubular member 11 slipped over the end portion of rigid tubular member 10 and retained in such concentric relation by compression of clamp 16. If desired, the end portion of rigid tubular member 10 may be formed or manufactured with a series of external circumferential ridges (not shown) as well understood in the art to better grip the flexible tubular member 11.

It is essential that the said composite liquid supply means consist of a main central flexible tubular portion or member 11 fixedly supported adjacent an end thereof and pivotally supported about a fixed point adjacent the other end, and further, that the linear spacing between the coupling 14 to the fixed rigid tubular member 10 and the coupling 17 to the pivotal rigid tubular member 12, seen in FIGS. 5 and 10, be sufficiently less than the length of the flexible tubular member 11 that a portion 18 of the latter, as shown in FIG. 5, is forced to bend and displace laterally, thus holding the pivotal rigid tubular member 12 at an angle of from about 1 to about 35 degrees, preferably from about 5 to about 15 degrees and most preferably about 10 degrees from a straight line drawn through the linear axis of the fixed rigid tubular member 10 to the axis of the pivotal rigid tubular member 12 at the point of pivotal support where an outer wall portion 19 of the pivotal rigid tubular member 12, as seen in FIG. 10, is formed in the shape of a partial ball, i.e., in the shape of a segment of a sphere between the equator and polar region thereof, and is supported by a mating, complementary ball socket bearing 20, the smallest diameter portion of which is most remote from the flexible tubular member 11.

It is not critical whether it is the fixed rigid tubular member 10 or the flexible tubular member 11 which is fixedly supported adjacent the coupling 14 between those members.

Figure 11:
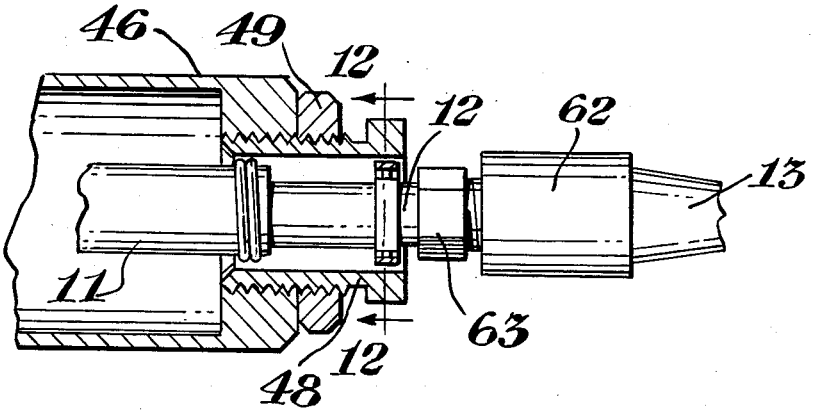
FIG. 11 is a view partly in full and partly in section of a fragmentary portion of a view similar to FIG. 10 but of an alternate embodiment having a gimballed support instead of partial ball and a ball socket bearing.
Figure 12:
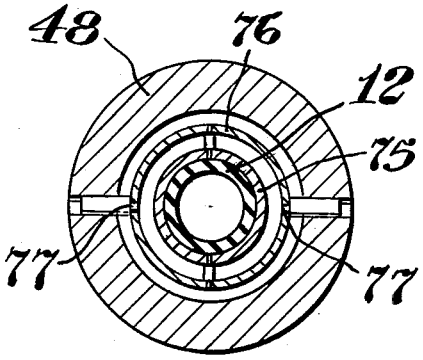
FIG. 12 is a greatly enlarged view taken along the line 12—12 of FIG. 11 further illustrating the gimballed structure.

If desired, in an alternative embodiment there may be employed a gimballed structure such as illustrated in FIGS. 11 and 12 instead of the partial ball 19 and ball socket bearing 20 combination previously shown, in order to provide universally pivotal support about a fixed point for the pivotal rigid tubular member 12. The pivotal rigid tubular member 12 is seen in FIG. 12 to immediately be surrounded by the inner ring 75 of the gimbal. Ring 75 pivots within ring 76 which in turn pivots on pins 77 which extend inwardly from sleeve 48 in the bearing mount 46.

In order to accomplish one of the principal objectives of the inventions, there is provided means for controllably continuously moving the laterally displaced portion 18 of the flexible tubular member 11 about a circular path substantially centered around said axis defined by a straight line drawn between the linear axis of the fixed rigid tubular member 10, and, the axis of the pivotal rigid tubular member 12 at its point of pivotal rotation.

Referring now more particularly to FIG. 5, such means can conveniently take the form of electric motor drive means 21 consisting of a conventional gear reduction assembly 22 housed in a body shell 23 and powered by an electric motor 24 having electric leads an electric power source, not shown. The type of power used is not critical and instead of an electric motor there may be used a hydraulic motor powered by a hydraulic pump driven in conjunction with the drive for the mobile platform, or an internal combustion engine may be used. Wherein 24 is a hydraulic motor, lines **24*a* and 24*b* are understood to be hydraulic lines and wherein 24 is an internal combustion engine 24*a* and 24*b* are understood to be fuel lines. Generally no gear reduction assembly is required if a hydraulic motor is used as a power source for the apparatus. A power shaft 25 extends through the end wall 26, shown in dotted outline, of the body shell 23 and is journalled therein in bearing 27**.

Figure 13:
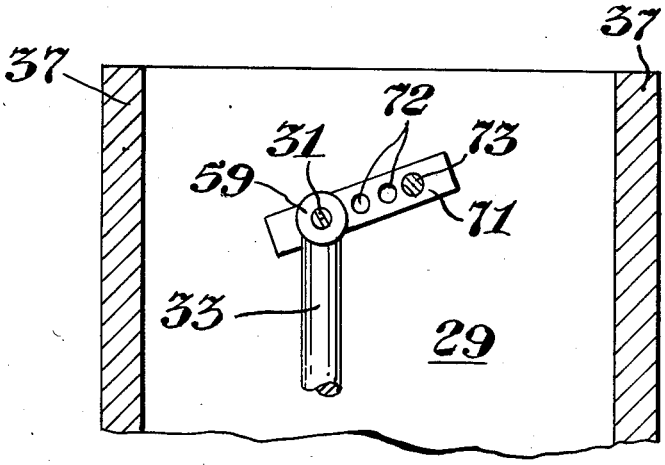
FIG. 13 is a fragmentary end view of the present device with the cover plate 29 removed as in FIG. 2, but showing another embodiment of the present apparatus in which an adjustable crank is employed instead of a disc wheel to impart reciprocal motion.

The power shaft extends further beyond the body shell 26 and through an aperture 28 in backing plate 29 and mounted thereon adjacent the end thereof is a disc wheel 30. In place of the disc wheel 30, a crank may be used as shown in FIG. 13, preferably, an adjustable crank. The disc wheel may be considered as a special form of crank which is simply a means for transforming circular motion into reciprocal motion. A wrist pin 31 extends perpendicularly from the outward face 32 of the disc wheel 30 at a location radially outwardly from the axis of rotation. Rotatably mounted on the wrist pin 31 is a connecting rod indicated generally by the reference numeral 33.

Figure 2:
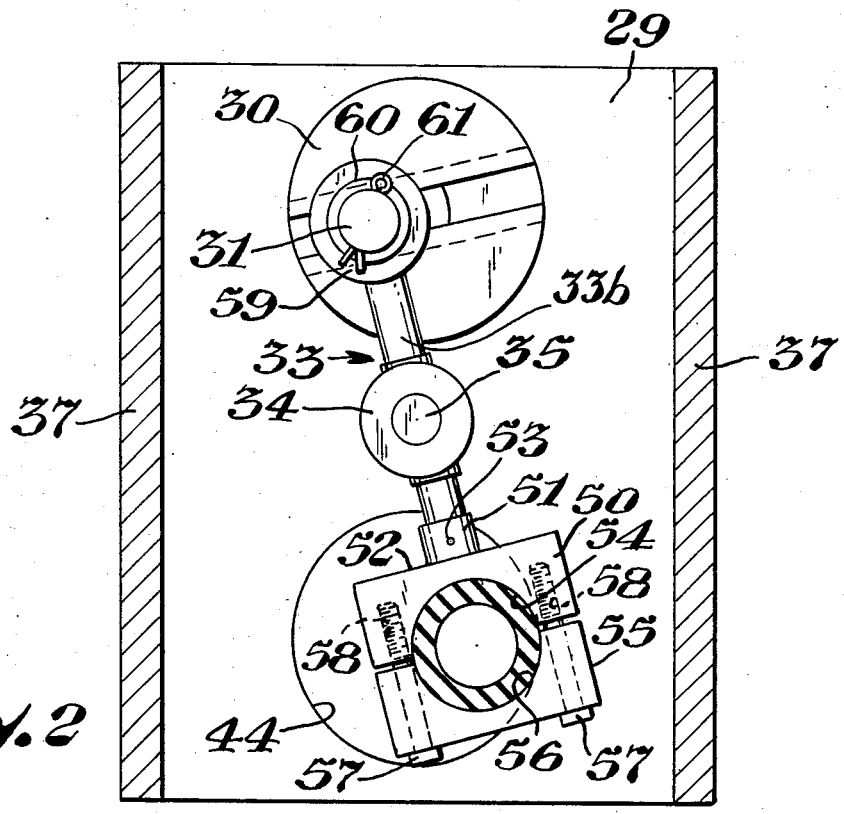
Figure 4:
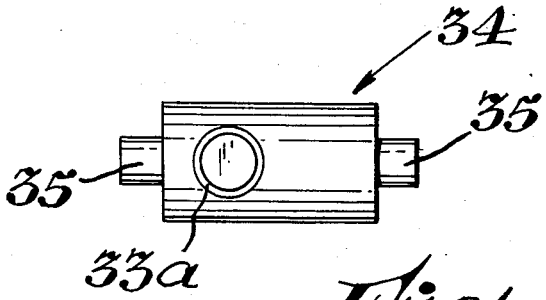
FIG. 4 is a side view of the guide through which the connecting rod reciprocates.

As seen with greater particularity in FIGS. 2 and 5, the connecting rod 33 at about its mid-section extends slideably through a cylindrical borehole **33*a* extending through an oscillatable guide 34. The oscillatable guide 34, shown separately in FIG. 4, is supported at its ends by axial pins 35, e.g., as shown in FIG. 5. The oscillatable guide 34 extends perpendicularly from the backing plate 29 and is rotatably journalled therein at one end and at the other end in a cover plate 36 which is spaced apart from and generally coextensive with the backing plate 29. The backing plate 29 and the cover plate 36 are rigidly attached and spaced apart, e.g., by virtue of the backing plate being a channel member with longitudinally extending lateral flanges 37 to which the cover plate 36 mates and is mounted by conventional mounting means (not shown), such as bolts traversing apertures in plate 36 and threading into tapped holes in flanges 37, the flanges being of sufficient width to provide space for the disc wheel 30 and connecting rod 33 and rotatable guide 34 to function. If desired, the lateral flanges 37 may be formed integrally with the cover plate 36** instead of with the backing plate, or one flange with each plate.

The backing plate 29 and the cover plate 36 are normally coextensive and extend substantially beyond the side or edge 38 of the gear reduction assembly 22 and together constitute main support elements of the apparatus. Mounted on that face 39 of the backing plate 29 which faces away from the cover plate 36 is an end 40*a* of an elongated sleeve 40 which may be hollow rectangular as shown, or cylindrical in form, and is positioned substantially parallel and closely adjacent to the electric motor drive means 21.

As seen in FIGS. 1, 5 and 6, the fixed rigid tubular member 10 and flexible tubular member 11 portion of the composite liquid supply means are largely enclosed within the elongated sleeve 40 and the adjacent spacing between the backing plate 29 and the cover plate 36. Referring particularly to FIG. 6, the fixed rigid tubular member 10 is shown to be provided with a circumferential integrally formed or attached boss or collar portion 41 against which the overlapping portion of the flexible tubular member typically is stopped in making the coupling 14. An important function of the boss 41 is to restrain the fixed rigid tubular member 10 from sliding axially out of the sleeve member 40 through the aperture 42*a* in the end wall 42 of the elongated sleeve 40 through which the rigid tubular member 10 extends. The portion of the rigid tubular member 10 which extends outside the elongated sleeve 40 is externally threaded and a nut 43 tightened against the end wall 42 holds the rigid tubular member 10 firmly in a fixed position, providing fixed support adjacent an end of the flexible tubular member 11.

The flexible tubular member 11 extends along the sleeve 40 and through relatively large respective apertures 44, 45 in the backing plate 29 and the cover plate 36. The apertures 44, 45 are generally aligned with the axis of the elongated sleeve 40 and are of adequate diameter to provide for the requisite range of lateral displacement widths desired of the displaced portion 18 of the flexible tubular member 11 required as illustrated especially in FIG. 5.

Reference is made to FIGS. 5 and 10 wherein the details of pivotal support of the other end of the composite liquid supply means are further illustrated. The flexible tubular member 11 extends also through said aperture 45 in the cover plate 36 and into a ball socket bearing mount 46 which is conveniently hollow cylindrical in form and is rigidly attached to the cover plate 36 in substantial alignment with and of greater diameter than the aperture 45. The flexible tubular member 11 terminates in the coupling 17 in which it overlaps and is slipped onto the end portion of the pivotal rigid tubular member 12.

The ball socket bearing mount 46 is provided with a partial closure in the form of a relatively thick end wall 47 having an internally threaded aperture in which is threadably received an externally threaded smaller sleeve member 48 having a partial ball socket bearing surface or socket 20 formed in the end wall thereof and having an aperture formed therethrough. Locking nut 49 upon the smaller sleeve member 48 may be tightened against the end wall 47 of the ball socket bearing mount 46 to hold the ball socket bearing sleeve 48 firmly in a pre-selected axial, i.e., longitudinal, position.

The partial ball portion 19 of the pivotal rigid tubular member 12 bears against the surface of the ball socket bearing 20 from the direction of the flexible tubular member 11 and is held thereagainst by the axially directed thrust of the flexible tubular member 11, which essentially must be sufficiently confined longitudinally to cause lateral displacement of the displaced portion 18. The length and diameter of the smaller sleeve member 48 are selected according to well understood principles of geometry to accommodate movement of the laterally displaced portion 18 of the flexible tubular member 11 and the proportionately displaced portions of the remainder of the flexible tubular member 11 and the attached pivotal rigid tubular member 12 inside the smaller sleeve member 48. The more lateral displacement desired, the shorter the sleeve member 48 must be and/or its internal diameter must be enlarged to accommodate the greater geometry.

Figure 14:
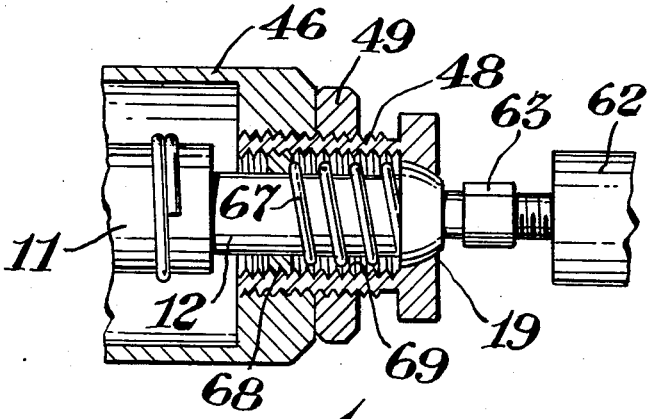
FIG. 14 is an enlarged fragmentary portion of a view in side elevation, partly in section and partly in full, similar to FIG. 10 but showing a collar and spring means for urging the partial ball against the ball socket bearing.
Figure 15:
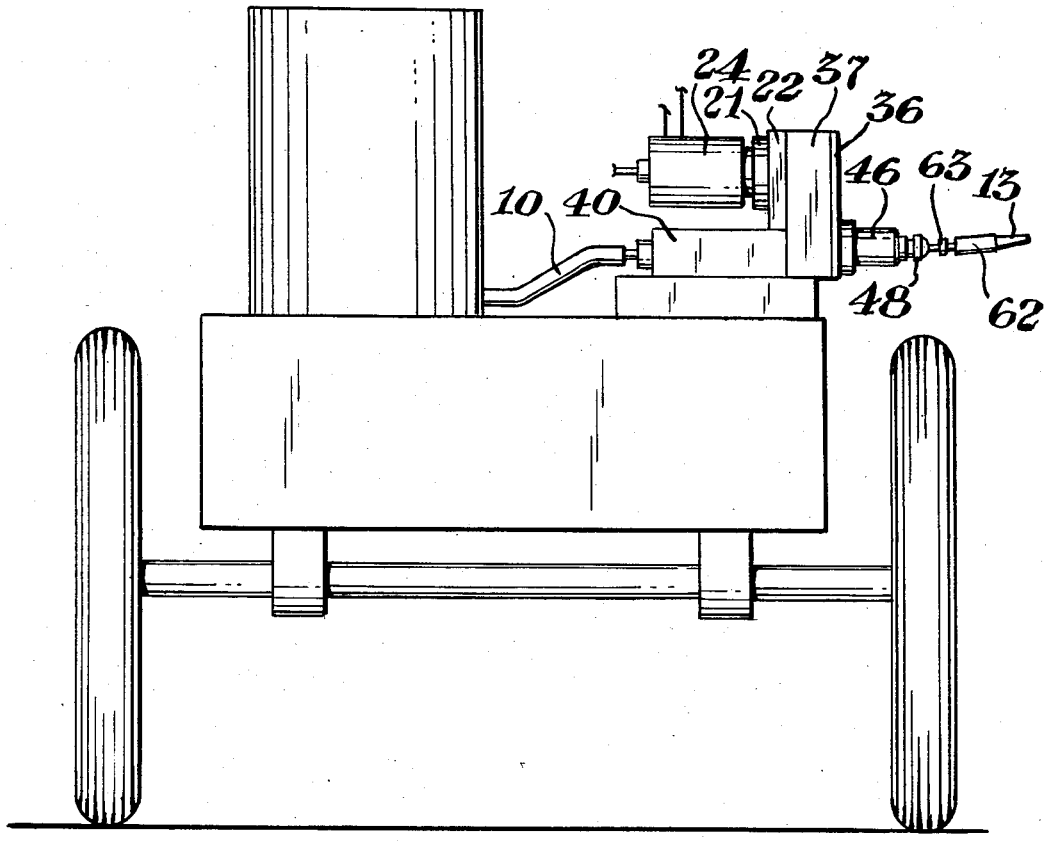
FIG. 15 is a plan view of the spray applicator device of the invention mounted on a mobile platform along with spray composition supply means.

If desired, the partial ball portion 19 of the pivotal rigid tubular member 12 may be urged against the ball socket bearing 20 as shown in FIG. 14 by a compressed cylindrically wound spring 67 circumferential to the shank of the pivotal rigid tubular member 12 and retained inside the smaller sleeve member 48 as by a collar 68 internally threaded into the said smaller sleeve member 48 which must be provided with internal threads 69.

The ball and ball socket bearing assembly described provides pivotal support for the rigid tubular pivotal support member 12 about a fixed position adjacent an end of the flexible tubular member 11.

Referring now to FIGS. 5 and 6 the laterally displaced portion 18 of the flexible tubular member 11, at the portion of greatest lateral displacement, is caused to rotate in a circular motion substantially concentric to a line drawn between the said axis of the fixed rigid tubular member 10 where coupled to the flexible tubular member 11 and the axis of the pivotal rigid tubular member 12 at the location of the partial ball 19 and ball socket bearing 20 assembly by the action of the connecting rod 33. The connecting rod 33, as indicated, extends reciprocatably through the oscillatable guide 34 and thence towards the flexible tubular member 11 as the latter extends through the apertures 44, 45 in the backing plate 29 and cover plate 36, respectively, and is attached to the flexible tubular member 11 by any suitable means. Conveniently, attachment may be by means of a yoke 50 in the form of a generally rectangular plate with a sleeve 51 extending from one edge 52 to receive the end of the connecting rod 33 attached therein as with a pin 53. The other edge 54 of the yoke 50 has a substantially semicircular concavity formed therein to receive the flexible tubular member 11 thereagainst. A mating cap 55 with a semicircular concavity 56 formed in an edge thereof is attached to the yoke 50 so as to embrace and grasp the flexible tubular member 11 when the cap 55 is tightened and held firmly to the yoke 50, as by bolts 57 extending transversely through the cap 55 from edge to edge and into tapped holes 58 in the yoke 50 adjacent the concavity thereof.

Rotation of the disc wheel 30 by the electric motor drive means 21 or other power drive means causes reciprocation of the shank 33*b* of the connecting rod 33 through the oscillatable guide 34 and angular oscillatory movements of the connecting rod 33 about the axis of the oscillatable guide 34 resulting in the yoke 50 and cap 55 assembly and the portion 18 of the flexible tubular member 11 grasped thereby reproducing the circular path motions of the enlarged end portion 59 of the connecting rod 33 carried rotatably by the wrist pin 31 in the face of the disc wheel 30, but proportionately as to the radius of such circular motions as determined by the relative spacings (1) from the wrist pin 31 to the axial pins 35 of the oscillatable guide 34 on the one hand and (2) from the said axial pins to the radial center of the concavity of the yoke 50 on the other hand. The shorter the first spacing the greater the diameter of the second circle by comparison, and vice versa, the longer the first spacing the smaller the diameter of the second circle.

Adjustment of the diameter of the circular path of the laterally displaced portion 18 of the flexible tubular member 11 is readily obtained, for example, by making provision to relocate the wrist pin 31 on the face of the disc wheel 30 at a preselected radial distance from the axis of the disc wheel by any suitable means, e.g., by providing tapped holes in the disc wheel at pre-selected locations in the disc wheel face.

Figure 3:
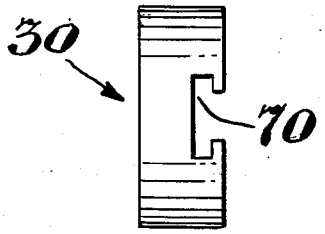
FIG. 3 is an enlarged side view of the motor driven disc wheel.

The disc wheel 30 shown in FIGS. 2, 3 and 5 is provided with a diametrically disposed undercut slot 70 milled thereinto, the slot being T-shaped in section and adapted to hold the polygonal head of a wrist pin 31, the shank of which extends perpendicularly from the face of the disc wheel 30 and carries the said enlarged end 59 of the connecting rod 33 thereon rotatably, the enlarged end being retained by any suitable means such as a washer 60 and cotter key 61 or a washer with a retaining nut (not shown) threaded into the wrist pin 31.

On adjusting the mounting of the wrist pin 31 closer to the axis of the disc wheel 30, the diameter of the circular path followed by the laterally displaced portion 18 of the flexible tubular member 11 is proportionately reduced and conversely if the wrist pin 31 is mounted further from the said axis.

If desired, an adjustable crank 71, as shown in the embodiment illustrated in FIG. 13, may be used in place of the disc wheel 30 and holes 72 provided therethrough for mounting the pin 31 at a preselected distance from the axis of rotation 73 of the adjustable crank 71. The disc wheel 30 serves as a special form of adjustable crank.

By the original design of the equipment, then, i.e., preselecting the relative length of the connecting rod 33 from the axis of the oscillatable guide 34 to the wrist pin 31, as contrasted to the length from said axis to the radial center of the concavity of the yoke 50, and by the adjustment of the radial location of the wrist pin 31 from the axis of rotation of the disc wheel 30 or the adjustable crank 71, the extent of pivoting of the nozzle means 13 of the present apparatus is selected and controlled to give the kind of spray pattern desired.

Referring more particularly to FIGS. 6 and 10, the pivotal rigid tubular member 12 is provided externally of the partial ball and ball socket bearing assembly with means for attaching the nozzle means 13 in fluid communication therewith. Generally, the pivotal support member 12 is externally threaded and an externally threaded nozzle or nozzle assembly 13 is connected end to end thereto with an internally threaded coupler 62. Conveniently, the pivotal support member 12 is provided with a polygonal boss portion 63 generally hexagonally formed circumferentially in the outer wall allowing ready use of a wrench to restrain rotation of the pivotal rigid tubular member while connecting or disconnecting the nozzle or nozzle assembly 13. The polygonal base portion 63 is not essential to employ, but if used, must be small enough to pass through the aperture in partial ball socket 20. If desired, such polygonal element need not be integrally formed with the rigid tubular member 20, but may be a separate element sweated or glued or tightly wedged thereonto e.g., after assembly of the entire composite liquid conduct means in and through the bearing mount 46, and the sleeve 48.

Nozzles providing a collimated stream of spray composition discharged therefrom are well known to the art and are commercially available and are preferred for use with the present apparatus.

Figure 9:
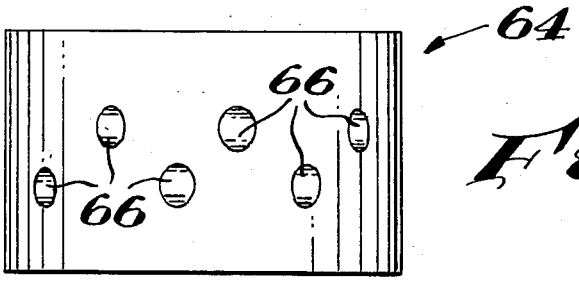
FIG. 9 is a side view of the multiple-port nozzle depicted in FIG. 7 as viewed from the fluid discharge side with the individual nozzles removed.
Figure 7:
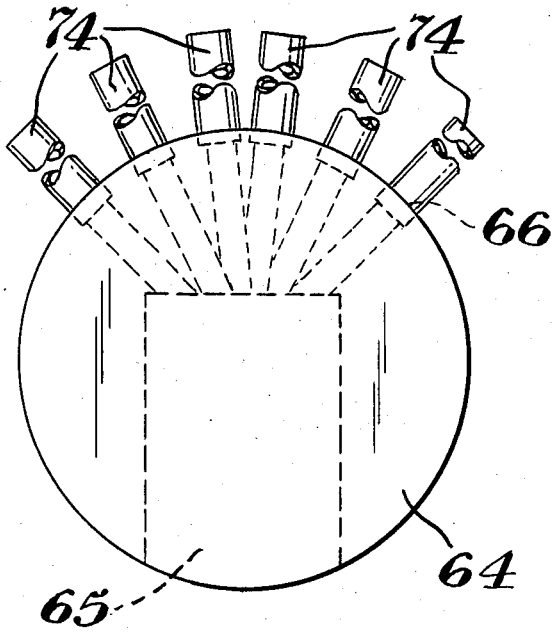
FIG. 7 is a greatly enlarged foreshortened top view of a multiple-port nozzle, suitable for use with the present orbital action spraying device.
Figure 8:
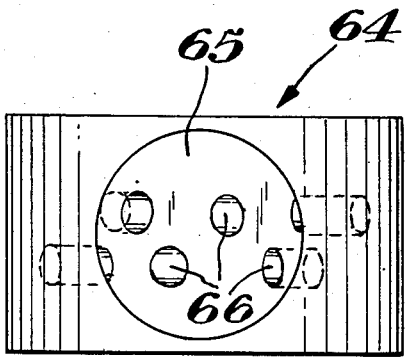
FIG. 8 is a side view of the multiple-port nozzle depicted in FIG. 7 as seen from the fluid inlet side with the individual nozzles removed.

Particularly preferred is an array of such nozzles mounted in a manifold. Such an array is readily made in the form shown in FIGS. 7, 8 and 9 in which a discate body 64 that is relatively thick in comparison to its diameter is provided with a large inlet borehole 65 bored out or formed, centered at mid-thickness, from one edge along a generally diametric line to a depth sufficient to intersect radially inward smaller outlet boreholes 66 formed in the edge opposite the inlet borehole 65 in an array encompassed within a sector not greater than about 90 degrees spread. Individual spray nozzles 74 are mounted in respective boreholes 66. It has also been found advantageous in achieving a good spray pattern to arrange the apertures of boreholes 66 alternately along two or more spaced apart planes as shown in FIGS. 8 and 9. A plurality of nozzles may be arrayed in such boreholes. The discate body 64 may be mounted on the pivotal rigid tubular member 12 by any suitable means, e.g., by internally threading borehole 65 which mates with the externally threaded distal end of the pivotal support member 12 or by the use of any conventional adapter means.

The apparatus is readily made from conventionally used materials of construction such as any of mild steel, aluminum or aluminum alloy or an alloy steel for the backing plate, cover plate, disc wheel, connecting rod, rotatable guide, elongated sleeve and ball socket bearing and ball socket bearing mount, butyl rubber tubing for the flexible tubular member, and molded nylon or rigid polypropylene or other polyalkylene for the fixed rigid tubular member, pivotal rigid tubular member, and nozzle holder or assembly body.

In practicing the method of the present invention in which a liquid pesticide composition is sprayed along a swath of substantially predetermined width, a mobile platform, such as a railroad car or a highway truck, or other vehicle as may be appropriate, is provided having the present spray apparatus thereon and means for supplying the liquid pesticide composition thereto, including a supply tank and a pump, drive means for the pump, and the requisite liquid supply conduit in the form of connecting piping and or flexible hose portions leading to the spray apparatus. The spray apparatus, as indicated hereinabove, is provided with nozzle means and liquid supply conduit means operatively interconnecting the said liquid supply conduit and the nozzle means.

The interconnecting liquid supply conduit means includes a flexible portion and a rigid portion, the latter connecting the flexible portion to the nozzle means and being pivotally supported between its ends and being pivotal about a fixed point whereby the distal end, i.e., discharge end, of the nozzle means describes a circular path. Means is provided for controllably continuously pivoting the said rigid portion of the liquid supply conduit means at a preselected angular momentum whereby the distal end of the nozzle means moves in a circular path, preferably at a rate in the range of about 50 to about 150 revolutions per minute, although in applications where there is less concern for spray drift the said rigid portion may be pivoted more rapidly and good, even distribution of spray composition may be attained along a swath of moderate to narrow width.

Among the advantages of the present apparatus is the absence of any rotating seals and attendant maintenance problems.

I claim:

1. Apparatus for controllably imparting a continuous orbital motion to the distal end of a spray nozzle member while providing pivotal support about a fixed point adjacent the proximal end of the spray nozzle member which comprises, in combination:

a fixed rigid tubular member, a flexible tubular member and a pivotal rigid tubular member, each of said members being interconnected in series in the sequence recited and each being in fluid communication with the adjacent member, and the pivotal rigid tubular member being adapted to be connected at its distal end to a spray nozzle member;

means for fixedly supporting the flexible tubular member adjacent the connection thereto the fixed rigid tubular member;

means for pivotally supporting the pivotal rigid tubular member adjacent the connection thereto the flexible tubular member;

and means for controllably continuously moving a laterally displaced portion of the flexible tubular member about a circular path substantially around an axis defined by a straight line drawn between the linear axis of the fixed rigid tubular member and the axis of the pivotal rigid tubular member at its point of pivotal rotation, whereby the distal portion of the pivotal rigid tubular member is adapted to move continuously in a circular path whereby a liquid stream discharged from a nozzle member connected to and mounted thereon describes the surface of the frustum of a cone as the nozzle member is pivoted about as a consequence of the motion of the flexible tubular member.

2. The apparatus of claim 1 in combination with a spray nozzle member.

3. The apparatus of claim 1 in combination with means for providing for a time to the distal end of the rigid tubular member a continuous supply of a liquid pesticidal composition under sufficient predetermined pressure to emit the composition operatively from a spray nozzle member attached to the discharge end of the pivotal rigid tubular member.

4. The apparatus of claim 1 wherein the means for controllably continuously moving a laterally displaced portion of the flexible tubular member about a circular path substantially around an axis defined by a straight line drawn between the linear axis of the rigid tubular member and the axis of the pivotal rigid tubular member at its point of pivotal rotation comprises:

means for longitudinally compressing said flexible tubular member whereby a portion thereof between the ends thereof is laterally displaced;

motor drive means;

a crank driven by the motor drive means;

a connecting rod rotatably connected at a first end to a pin projecting perpendicularly from a face of the crank, and at a second end to means for attachment to the laterally displaced portion of the flexible tubular member, the connecting rod being positioned along a plane substantially parallel to the face of said crank;

a connecting rod guide oscillatably supported so as to intercept the said plane parallel to the face of the crank and substantially along a line between the axis of rotation of the crank and the laterally displaced portion of the flexible tubular member and the connecting rod extending slideably through an aperture formed in the connecting rod guide;

5. The device as in claim 4 in which the motor drive means is an electric motor operatively coupled to gear reduction means, the output of which is used to drive said crank.

6. The device as in claim 4 in which the motor drive means is an internal combustion engine operatively coupled to gear reduction means, the output of which is used to drive said crank.

7. The device as in claim 4 in which the motor drive means is a hydraulic motor, the output of which is used to drive said crank.

8. The device as in claim 4 in which the crank takes the form of a disc wheel.

9. The device as in claim 4 in which the crank has an axis of rotation and said pin is adjustably mounted on the face of the crank at a preselected spacing from said axis of rotation.

10. The apparatus of claim 1 wherein the means for pivotally supporting the pivotal rigid tubular member adjacent the connection thereto the flexible tubular member comprises a concentric circumferentially enlarged outer wall portion between the ends thereof the pivotal rigid tubular member in the form of a partial ball, the surface thereof being that of a spherical segment between the equator and polar region thereof, the smallest diameter portion of the ball being most remote from the flexible tubular member, a ball socket bearing mating with said partial ball and having a central aperture through which the rigid tubular pivotal support member extends, and means for fixedly supporting the ball socket bearing.

11. The apparatus of claim 1 wherein the means for pivotally supporting the pivotal rigid tubular member is a gimballed structure and means for fixedly supporting the gimballed structure.

12. The apparatus of claim 1 mounted upon a mobile platform along with spray composition supply means.

13. Apparatus for controllably imparting a continuous orbital motion to the distal end of a spray nozzle member while providing pivotal support about a fixed point adjacent the proximal end of the spray nozzle member which comprises, in combination:

a fixed rigid tubular member, a flexible tubular member a pivotal rigid tubular member and a spray nozzle member, each of said members having a first and a second end, and each being interconnected in series in the sequence recited herein and in fluid communication each with the adjacent member;

the flexible tubular member having its first end connected to the first end of the fixed rigid tubular member and being fixedly supported adjacent said first end; the flexible tubular member having its second end connected to the first end of the pivotal rigid tubular member; the pivotal rigid tubular member having means at its second end for coupling thereto the spray nozzle member and between said first and second ends, a concentric circumferentially enlarged outer wall portion to provide a partial ball surface; the partial ball surface being that of a spherical segment between the equator and polar region thereof and the polar region being the more remote from the flexible tubular member;

a sleeve member, a backing plate and a motor drive means, said motor drive means having a body shell, said body shell having an aperture in a sidewall thereof and a bearing seated therein through which a power shaft from the motor drive means extends and is journalled therein;

said backing plate being attached to the sidewall of said body shell and having a first aperture therethrough substantially aligned with the aperture in said sidewall of the body shell and adapted to receive therethrough the said power shaft; said backing plate extending well beyond an edge of said body shell and having attached thereto a first end of the elongated sleeve member positioned adjacent to and substantially parallel to the motor drive means, the backing plate having a second aperture substantially aligned with the body cavity of the sleeve member; the sleeve member being substantially closed by an end wall at the second end thereof except for a substantially centrally located circular aperture formed therethrough the end wall; the second end of said rigid tubular member extending through the aperture in said end wall and having means for securing the said end wall thereto preventing axial movement thereof and providing fixed support for the rigid tubular member and the said flexible tubular member connected thereto, said flexible tubular member extending inside said sleeve member to the first end thereof and through and beyond the aligned aperture of the backing plate;

a disc wheel, a connecting rod, a connecting rod guide, a yoke, a cap and a cover plate, said disc wheel being mounted on the power shaft of said motor drive means adjacent said backing plate, said connecting rod having first and second ends and a shank portion, the first end having journalled therein a wrist pin mounted in the face of the disc wheel, the second end being attached to said yoke and the shank portion slideably extending through an aperture formed transversely through the connecting rod guide, the cover plate having opposed and outer faces and an aperture formed therethrough and being fixedly supported substantially parallel thereto and spaced apart from the backing plate with the opposed face turned thereto, the connecting rod guide having ends oscillatably journalled in the opposing faces of the backing plate and the cover plate; the yoke at the end of the connecting rod having a substantially semicircular concavity in the edge facing away from the connecting rod; the cap mating with and being mounted on the yoke and having a complementary substantially semicircular concavity in the edge facing the yoke; the yoke and cap together surrounding and grasping the flexible tubular member extending from the said second aperture in the backing plate;

a hollow substantially cylindrical ball socket bearing mount having an outwardly flanged end and an internally threaded end, the flanged end being attached to the outer face of the backing plate and the cylindrical opening being substantially aligned with the aperture in the cover plate;

a generally cylindrical externally threaded ball socket member having a first end with a hemispherical ball socket bearing surface formed therein the end wall and an inwardly concentric aperture formed therein, the second, open end of the ball socket bearing member being threaded into the internally threaded end of the ball socket bearing mount;

the flexible tubular member further extending through the aperture in the cover plate and into and partially through the cavity in the ball socket bearing mount wherein the second end of the flexible tubular member is connected to the pivotal rigid tubular member;

the partial ball portion of the pivotal rigid tubular member being seated in the ball socket of the ball socket bearing member and held thereagainst by end thrust outwardly from the cover plate by reason of the assembly of tubular members in series being of a total preselected length exceeding the distance from the end closure of the elongated sleeve member to the ball socket bearing whereby the flexible tubular member, even when unconfined by the yoke and cap, yields and a portion thereof is laterally displaced from a line between the said end closure of the elongated sleeve member and the ball socket bearing;

and said spray nozzle member being operatively connected to the outwardly extending, second end of the pivotal rigid tubular member.

14. The apparatus as in claim 13 in which the disc wheel is provided with a substantially radially disposed undercut T-shaped slot across the face directed toward the cover plate and means for adjustably mounting said pin so as to extend from said slot.

* * * * *